US005298912A

United States Patent [19]

Mano et al.

[11] Patent Number: 5,298,912

[45] Date of Patent: Mar. 29, 1994

[54] MULTI-TONE DISPLAY DEVICE

[75] Inventors: Hiroyuki Mano; Kiyokazu Nishioka, both of Yokohama; Toshio Futami, Mobara; Kiyoshige Kinugawa, Chiba, all of Japan

[73] Assignee: Hitachi, Ltd, Tokyo, Japan

[21] Appl. No.: 844,965

[22] Filed: Feb. 28, 1992

Related U.S. Application Data

[63] Continuation of Ser. No. 475,849, Feb. 6, 1990, abandoned.

[30] Foreign Application Priority Data

Mar. 20, 1989 [JP] Japan ..... 1-66102

[51] Int. Cl.[5] ..... G09G 3/36

[52] U.S. Cl. ..... 345/88; 345/94

[58] Field of Search ..... 340/784, 703, 793, 771; 359/54, 55, 84; 358/236; 345/90

[56] References Cited

U.S. PATENT DOCUMENTS

| | | | |
|---|---|---|---|
| 3,972,040 | 7/1976 | Hilsum et al. | 340/784 |
| 4,353,062 | 10/1982 | Lorteije et al. | 340/767 |
| 4,571,584 | 2/1986 | Suzuki | 340/784 |
| 4,745,461 | 5/1988 | Shirai et al. | 358/236 |
| 4,748,444 | 5/1988 | Arai | 340/784 |
| 4,766,430 | 8/1988 | Gillette et al. | 340/784 |
| 4,775,891 | 10/1988 | Aoki | 340/784 |

FOREIGN PATENT DOCUMENTS

| | | | |
|---|---|---|---|
| 1-33533 | 2/1989 | Japan | 340/784 |

*Primary Examiner*—Ulysses Weldon

*Attorney, Agent, or Firm*—Antonelli, Terry, Stout & Kraus

[57] ABSTRACT

This specification discloses a novel multi-tone display matrix display device. The matrix display device according to an embodiment of the present invention comprises a matrix display panel having a matrix composed of plural X direction signal lines and plural Y direction signal lines lying at right angles thereto, intersecting points on the matrix being pixels of an image to be displayed, an X direction driving section for sequentially scanning the X direction signal lines to provide image signals, a Y direction driving section for driving the Y direction signal lines in synchronism with the scanning of the X direction signal lines to sequentially provide select signals to the Y direction signal lines, an A-D converter section for receiving an analog signal and converting it into a digital signal, a voltage generating section for generating signals at plural voltage levels, and a selector section for selecting an output signal from the voltage generating section in accordance with the output from A-D converter section and providing it to the X direction driving section as an image signal.

20 Claims, 9 Drawing Sheets

MULTI-TONE DISPLAY DEVICE

This application is a continuation of application Ser. No. 475,849, filed on Feb. 6, 1990, now abandoned.

BACKGROUND OF THE INVENTION

The present invention relates to a matrix display device, and more particularly to a device for displaying an image in plural tones in response to an analog image signal.

In recent years, matrix display devices including a liquid crystal display, a plasma display, an EL (electroluminescence), etc. have been developed as display devices in place of CRT display devices.

The display screen of the matrix display device has plural X signal lines arranged in a horizontal (X) direction of the screen, and plural Y signal lines in a vertical (Y) direction thereof; each of picture cells (pixels) is displayed at each of intersecting points of the X and Y signal lines. The X signal lines are supplied with image signals (luminance or color signals), whereas the Y signal lines are supplied with selective signals for scanning lines.

Several techniques of the display for the matrix display device, which can make the display with multicolor and multi-tone as in the CRT display device, have been developed. For example, in the liquid crystal matrix display device, different tones can be exhibited in terms of different integration values of transmission light beams for liquid crystal cells. The different integration values of transmission light beams can be exhibited by thinning out image signals for each frame of the image display, or pulse-width modulating the image signals supplied to the X signals. In these techniques, the difference in time-integration values of image signals are converted into different tones. On the other hand, if the liquid crystal devices which continuously vary in their transmissivity in accordance with varying applied voltages is used, it is possible to exhibit the tone by controlling the applied voltage.

JP-A-62-195628 filed on Jan. 13, 1986 by HITACHI, LTD. in Japan discloses a liquid crystal display device which provides monochrome or 8 (eight)-color display in accordance with input signals which are binary digital signals. JP-A-61-75322 filed on Sep. 20, 1984 by FUJITSU GENERAL Co. Ltd. discloses a system which provides tone display by changing signal levels between adjacent fields. JP-A-59-78395 filed Oct. 27, 1982 by SUWA SEIKOSHA Co. Ltd. discloses a multi-tone display system using pulse-width modulation.

Now referring to FIGS. 1 and 2, the operation of a liquid crystal matrix display device which does not have the function of tone display will be explained. An input signal for this matrix display device is a binary digital signal represented by the value of "0" or "1".

In FIG. 1, 1 is a liquid crystal display device (or liquid crystal display module, hereinafter referred to as LCM) provided with a matrix shape liquid crystal panel 17 the pixels of which are selected by X signal lines and Y signal lines. 18 is display data in which display ON (white) is represented by "1" and display OFF (black) is represented by "0". 3 is a latch clock in synchronism with the display data 18. 4 is a horizontal clock indicative of the period during which the amount of display data corresponding to one horizontal display is sent. 5 is a head line signal. 19 is a voltage generating section. 20 is a display ON voltage. 21 is a display OFF voltage. 13 is a selected voltage. 14 is a non-selected voltage. These voltages are generated by the voltage generating section. 22 is an X driving section for driving X-signal lines which is reset by the trailing edge of the horizontal clock, takes in the display data 18 corresponding to one horizontal display, converts the display data taken into a display ON voltage for the data "1" and into a display OFF voltage for the data "0", and finally outputs the converted voltage in accordance with the next trailing edge of the horizontal clock 4. X1–X640 are panel data which are output voltages from the X driving section. 16 is a Y driving section for driving Y signal lines. Y1–Y200 are scanning signals The Y driving section 16 takes in the head line signal in accordance with the trailing edge of the horizontal clock 4, initially takes the scanning signal Y1 as the selected voltage 13, and shifts the selected voltage 13 in the order of scanning signals Y2, Y3, . . . Y200 (each of the scanning signals other than the scanning signal which is a selected voltage 13 is a non-selected voltage 14). The liquid crystal panel 17 displays data on the line corresponding to the scanning signal Y1 which is at the level of the selected voltage in accordance with the panel data X1–X640 which are X-signal-line driving voltages X1–X640 generated from the X driving section 22.

FIG. 2 is a timing chart for explaining the operation of the LCM 1.

In FIG. 1, the X driving section 22 successively takes in the display data for each one line in synchronism with the latch clock 3 and in accordance with the subsequent horizontal clock 4, outputs as panel data X1–X640, the display ON voltage 20 or the display OFF voltage selected by "1" or "0" of each data. As shown in FIG. 2, therefore, the X driving section 22 outputs the voltage selected by the data for a 200-th line which is a last line while taking in a first line data, and outputs the voltage selected by the first line data while taking in a second line data. Namely, the output of display data lags by one line from the take-in thereof. Then, in order that the scanning signal on the line to be output by the X driving section 22 is the selected voltage, the Y driving section 16 takes in the head line signal 5 at the timing of the horizontal clock 4, takes the scanning signal Y1 as the selected voltage 13 and thereafter shifts the selected voltage 13 in accordance with the horizontal clock 4. In accordance with the voltage of each of the panel data X1–X640, the display panel 17 displays "white", on the line corresponding to the scanning line which is the selected voltage, when it is the display ON voltage and displays "black" when it is the display OFF data.

Color display (8 color display) can be made by arranging color filters of red, green and blue in the direction of lines (Y direction) or the direction of dots (X direction), and additively mixing three dots (3 bit data) constituting one dot (pixel) of visible information through display ON or OFF thereof.

Meanwhile, development of multi-color and multi-tone display in accordance with the demand for multi-color display and multi-tone display gave rise to a problem of interface between information processing devices such as between a liquid crystal panel and a personal computer. More specifically, if 4096 colors are to be displayed, signal lines corresponding to 4 bits are required for each of R (red), G (green) and B (blue) so that a total of 12 signal lines are required. Further, if 32768 colors are to be displayed, signal lines corresponding to 5 bits (total of 15 signal lines) are required for each of R, G and B. Increase in the number of signal lines will complicate the interface between e.g. the display panel and the personal computer and give rise to unnecessary radiation. This can be prevented by using analog input signal lines.

SUMMARY OF THE INVENTION

An object of the present invention is to provide a new matrix display device in a multi-tone display system which is different from the conventional matrix display systems.

In the display device according to an embodiment of the present invention, an analog signal is used as an input signal. The analog signal is A-D converted into a digital signal. A voltage generating device is provided to generate plural voltages in accordance with tones to be displayed. An output voltage from the voltage generating device is selected in accordance with the value represented by the digital signal. The selected voltage is applied to a display element to display a desired tone.

A matrix display device according to an embodiment of the present invention comprises a matrix display panel having a matrix composed of plural X direction signal lines and plural Y direction signal lines lying at right angles thereto, intersecting points on the matrix being pixels of an image to be displayed, an X direction driving section for sequentially scanning the X direction signal lines to provide image signals, a Y direction driving section for the Y direction signal lines in synchronism with the scanning of the X direction signal lines to sequentially provide select signals to the Y direction signal lines, an A-D converter section for receiving an analog signal and converting it into a digital signal, a voltage generating section for generating signals at plural voltage levels, and a selector section for selecting an output signal from the voltage generating section in accordance with the output from A-D converter section and providing it to the X direction driving section as an image signal.

DESCRIPTION OF THE PREFERRED EMBODIMENTS

Figure 1:
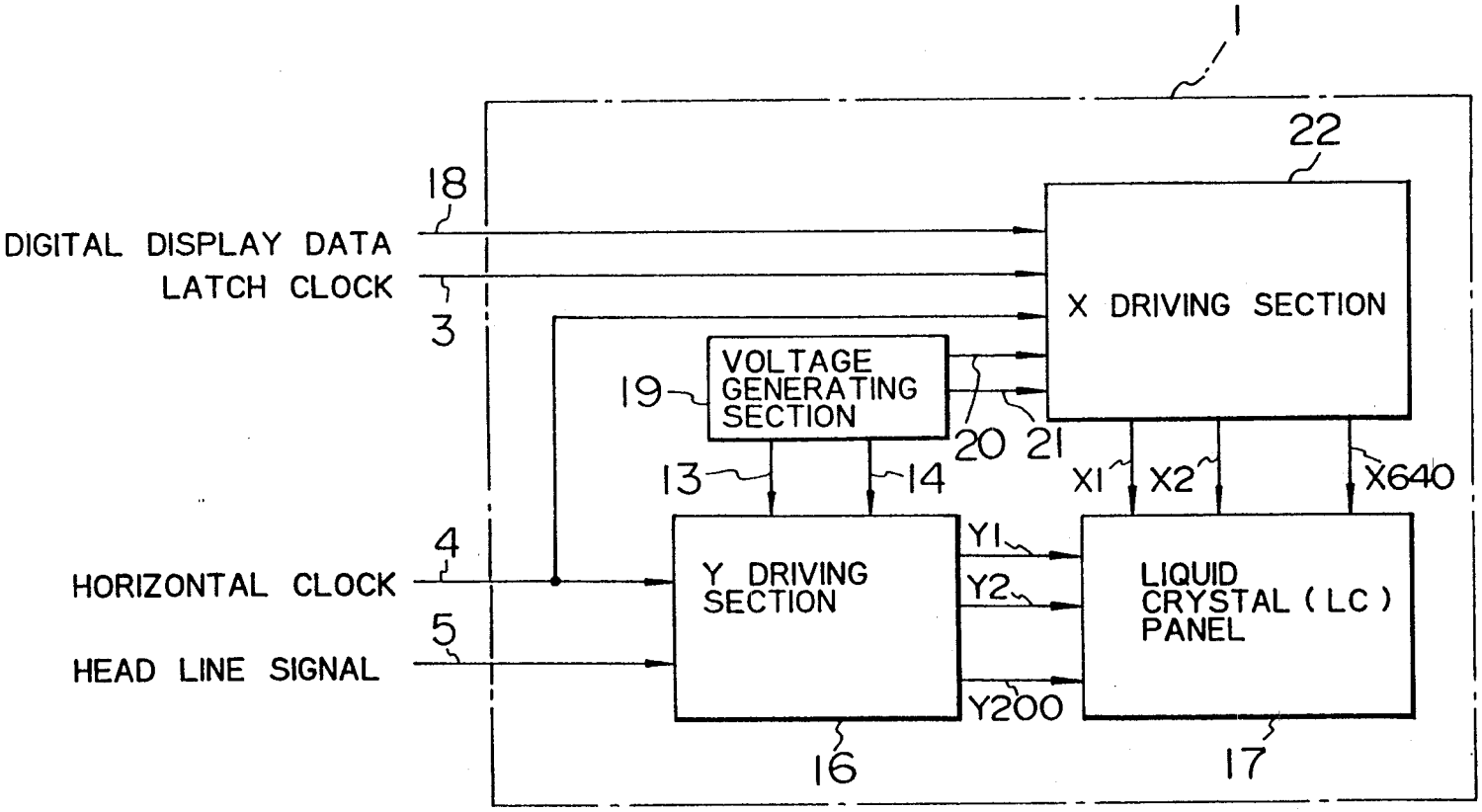
FIG. 1 is a block diagram of a liquid crystal matrix display device for displaying an image in response to a digital signal input.
Figure 3:
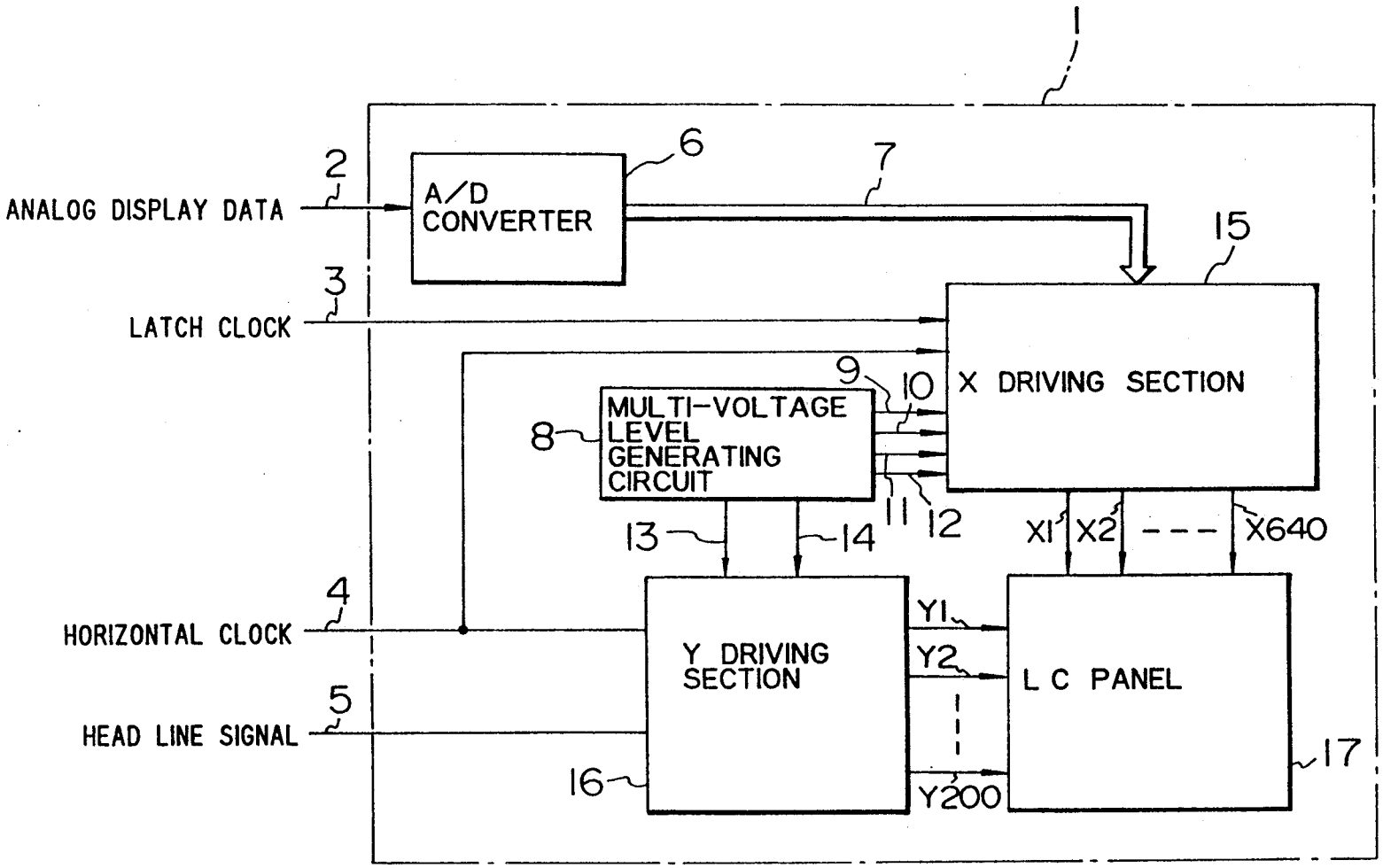
FIG. 3 is a block diagram of a liquid crystal matrix display device according to a first embodiment of the present invention.
Figure 4:
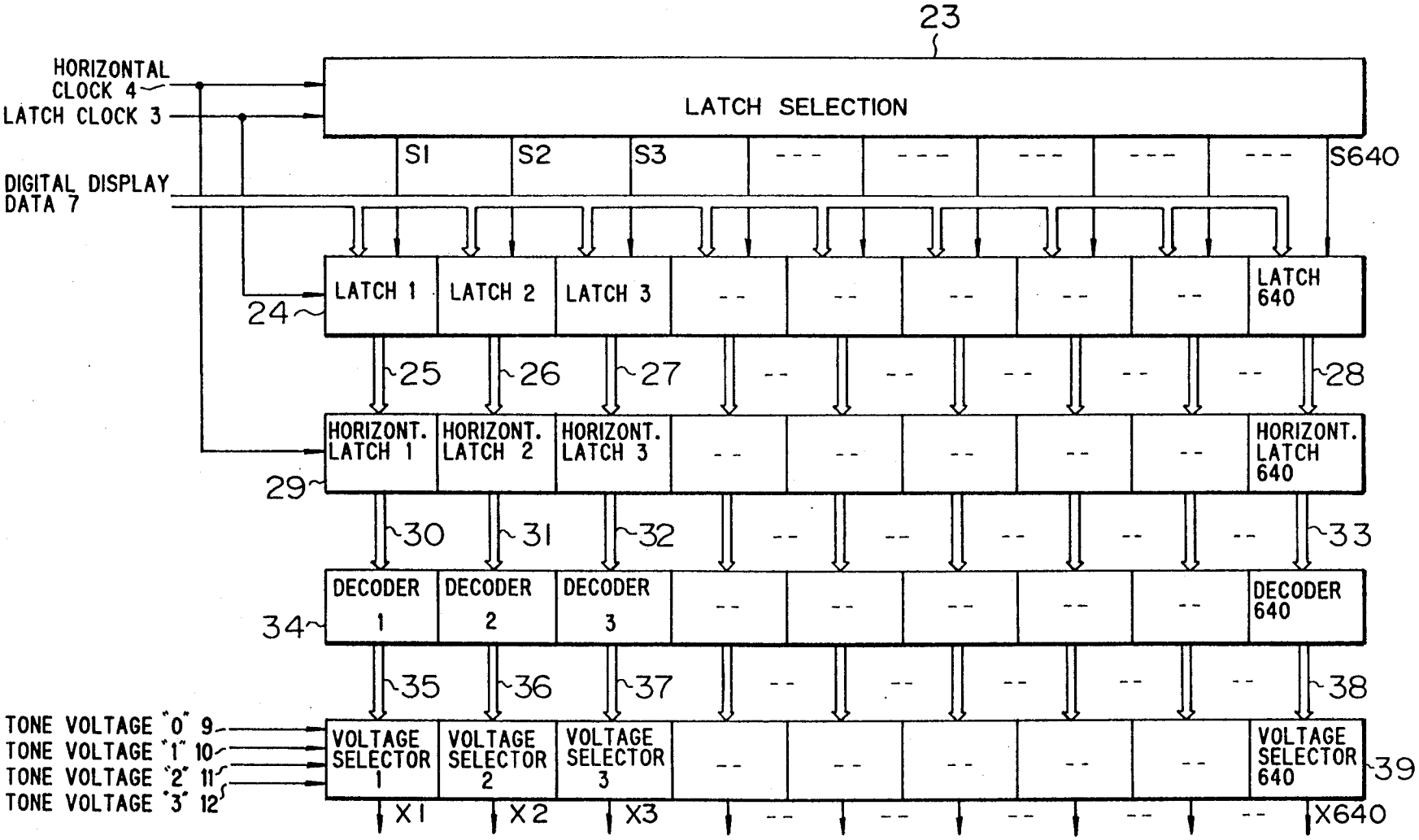
FIG. 4 is a block diagram of an example of the X driving section of FIG. 3.

Now referring to FIGS. 3 and 4, an embodiment of a multi-tone display LCM is illustrated according to the present invention. In this embodiment, it should be noted that an analog display data or signal (stepwise analog signal) 2 having different voltage levels corresponding to the number N of tones to be displayed is input to the display device. For simplicity of explanation, it is assumed that N=4, the analog input signal is represented by the voltage levels corresponding to 4 (four) tones. The analog signal is sent from an image display output of e.g. a personal computer In FIG. 3, 6 is an A-D converter section; 7 is a digital display data. The A-D converter section 6 converts the analog display data 2 as an input into the digital display data which is represented by 2 bits; more specifically, four value voltage levels of the analog display data are converted into (0, 0), (0, 1), (1, 0), and (1, 1) from the lower levels. 8 is a multi-voltage-level output generating circuit for generating constant voltages at plural levels in accordance with tones to be displayed, e.g. voltages at four different levels since this embodiment is directed to 4 tone display. The signal at the voltage level corresponding to tone 0 is output to a signal line 9. The signals at voltage levels corresponding to tone 1, tone 2 and tone 3 are output to signal lines 10, 11, and 12 respectively. 15 is an X driving section which takes in 2 bit digital data 7 sequentially one line at a time in synchronism with the latch clock 3, selects one of the four tone voltages output to the signal lines 9, 10, 11 and 12 in accordance with the decoded value of data for each dot and outputs it as panel data X1-X640. The remaining reference numbers denote like parts in FIG. 1.

FIG. 4 shows an example of the X driving section shown in FIG. 3. In FIG. 4, 23 is a latch selector and S1-S640 are select signals. The latch selector 23 is cleared by horizontal clock 3 and sequentially boosts the select signals S1, S2, . . . S640 "high" in synchronism with the succeeding clocks 3. 24 is a latch circuit which serves to latch the digital display data 7 in blocks (latch 1-latch 640) in which the select signal is "high". 25 to 28 are outputs from the respective blocks of the latch circuit 24, i.e. 2 bit latch data 1 to 640. 29 is a horizontal latch circuit which latches the latched data 1 to 640 in horizontal latches 1 to 640 in synchronism with the horizontal clock 4. 30 to 33 are outputs from the respective blocks of the horizontal latch circuit 29, i.e. 2 bit horizontal data 1 to 640. 34 is a decoder which serves to decode the horizontal data 1 to 640 by the corresponding decoder blocks (decoders 1 to 640). Numerals 35 to 38 are outputs from the decoder blocks, i.e. decoded values 1 to 640. Numeral 39 indicates a voltage selector which serves to select one of the tone voltages in accordance with the decoded values 1-640.

Figure 2:
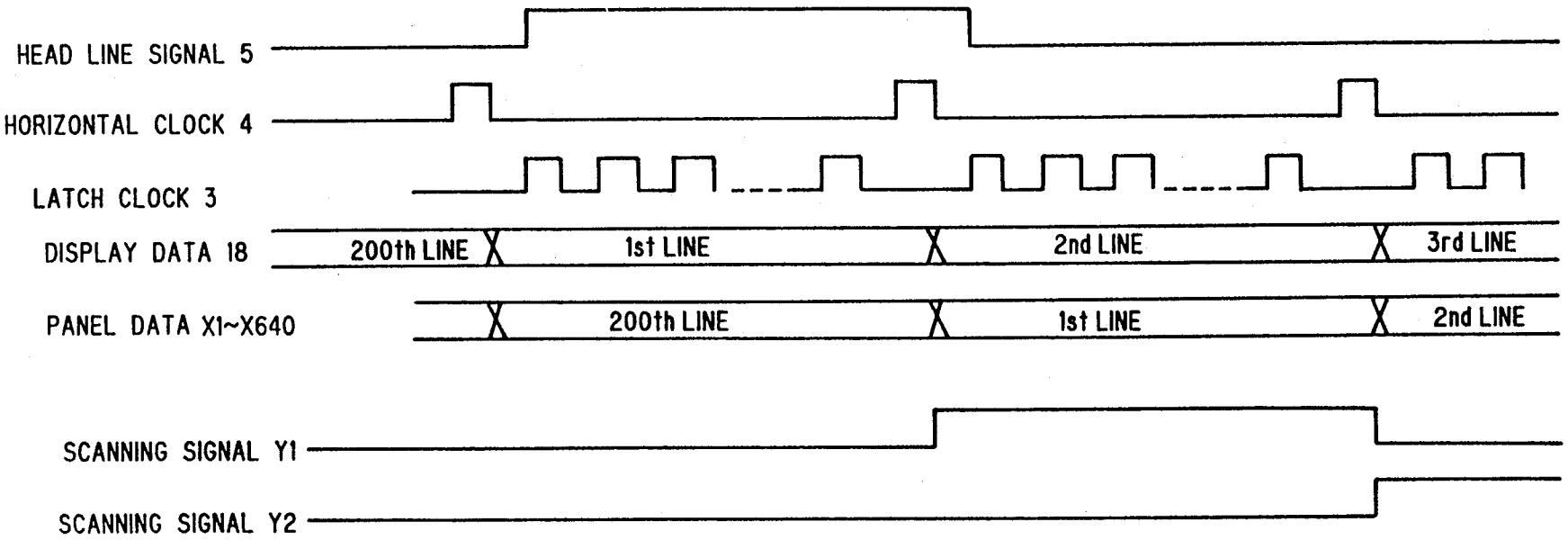
FIG. 2 is a waveform chart for explaining the operation of the display device of FIG. 1.

Now referring to FIGS. 3 and 4, the operation of the multi-tone display LCM 1 shown in FIG. 3 will be explained. In FIG. 3, the analog display data 2 is converted into the 2 bit digital data 7 by the A-D converter section 6; the 2 bit digital display data 7 is input to the X driving section 15. The X driving section 15 takes the display digital data 7, in synchronism with the latch clock 3 (FIG. 2), to one latch block of the latch circuit 24 to which a "high" select signal is being input. The latch selector 23 shifts the "high" state of the select signal each time the latch clock 3 is input. The latch circuit 24 takes in the sequentially sent digital display data 7 in the latch blocks 1, 2, . . . 640. When the latch circuit 24 has taken in the digital display data 7 corresponding to one line, i.e. up to latch block 640, the horizontal clock (FIG. 2) is applied to the X driving section 15 to clear the latch selector 23; then the X driving section stands by for next take-in of the digital display data 7. The data latched by the latch circuit 24 is sent to the horizontal latch circuit 29 which latches the data from the latch circuit 24 in synchronism with the horizontal clock 4 (FIG. 2). The horizontal data 30 to 33 which are outputs from the horizontal latch circuit 29 are sent to the decoder 34 and decoded by the decoder blocks 1 to 640 thereof; the decoded values 35 to 38 are output from the decoder 34. In the voltage selector 39, the selector blocks 1 to 640, in accordance with the decoded values, selects tone 0 voltage 9 if the decoded value is "0", tone 1 voltage 10 if it is "1", tone 2 voltage 11 if it is "2", and tone 3 voltage 12 if it is "3". The tone voltages output from the voltage selector blocks are sent to the liquid crystal panel 17 as panel data X1 to X640. Thus, the four value voltages output from the X driving section 15 are applied to the liquid crystal elements corresponding to the line selected by the Y driving section 16 in response to the select voltage 13 sent from the voltage generating circuit 8. In this way, the LCM 1 shown in FIG. 3 can realize four tone display.

Although the four tone display has been adopted in this embodiment, $2^N$ tone display can be realized. More specifically, if the input analog display data is represented by $2^N$ (N is an integer of 1 or more) levels, it is converted into N bit digital data by the A-D converter section 6, the data width in the internal circuits in the X driving circuit 15 is set at N bits, and $2^N$ kinds of tone voltage are supplied to the X driving section 15 to display $2^N$ tones.

Figure 5:
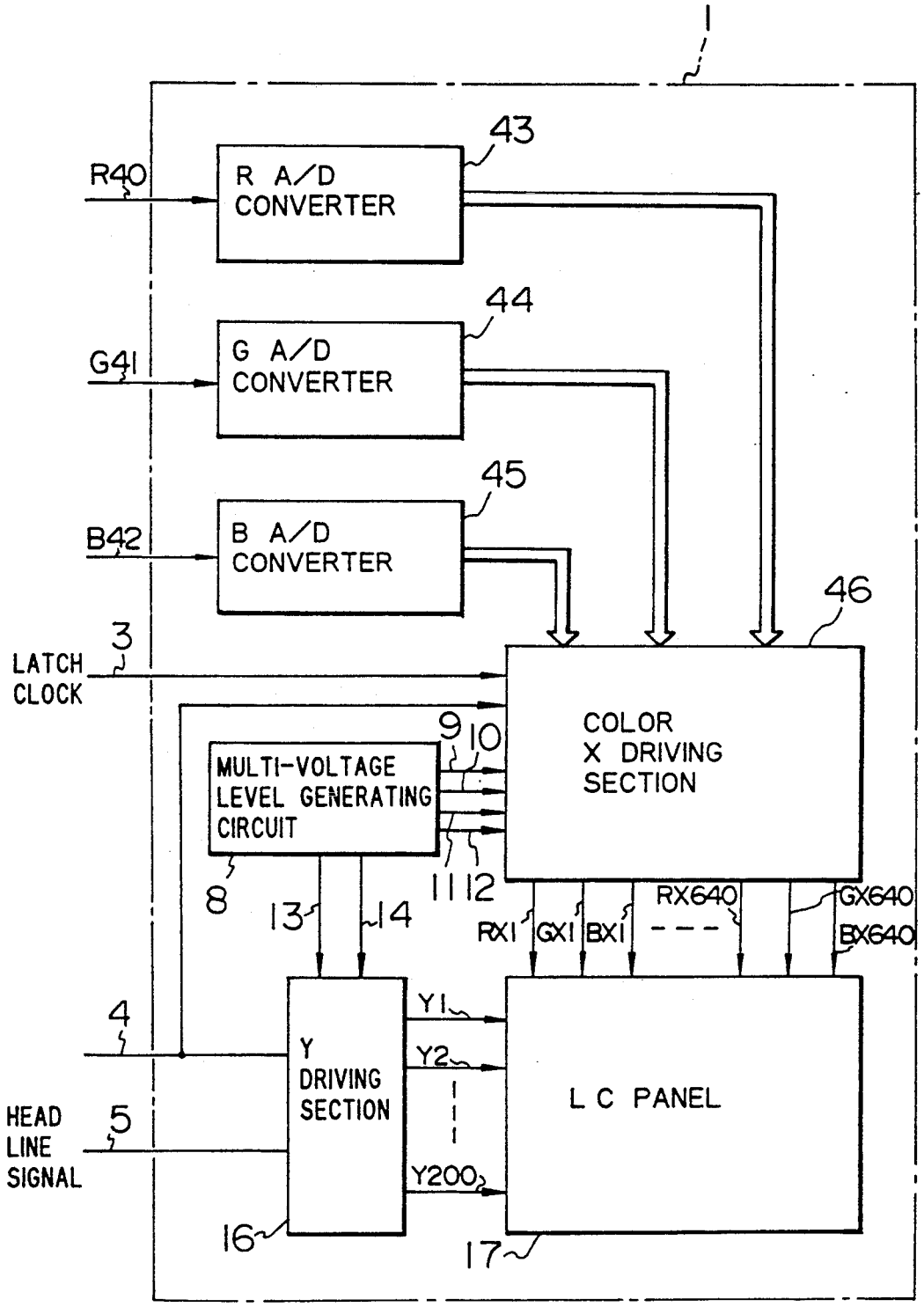
FIG. 5 is a block diagram of an embodiment of a liquid crystal matrix display device (LCM) for color display according to the present invention.

Now referring to FIG. 5, one embodiment of the LCM for multi-color display will be explained. The multi-color display can be realized by arranging color filters of R (red), G (green) and B (blue) in the direction of dots on the liquid crystal panel 17, providing A-D converter sections 43, 44 and 45 for R40, G41 and B42 as input analog display data, and applying the outputs from the R, G and B A-D converter sections 43, 44 and 45 to a color X driving section 46. In this case, the color X driving section 46 has three columns of the arrangement shown in FIG. 4 and thus the corresponding panel data are RX1-RX640, GX1-GX640 and BX1-BX640.

Figure 6:
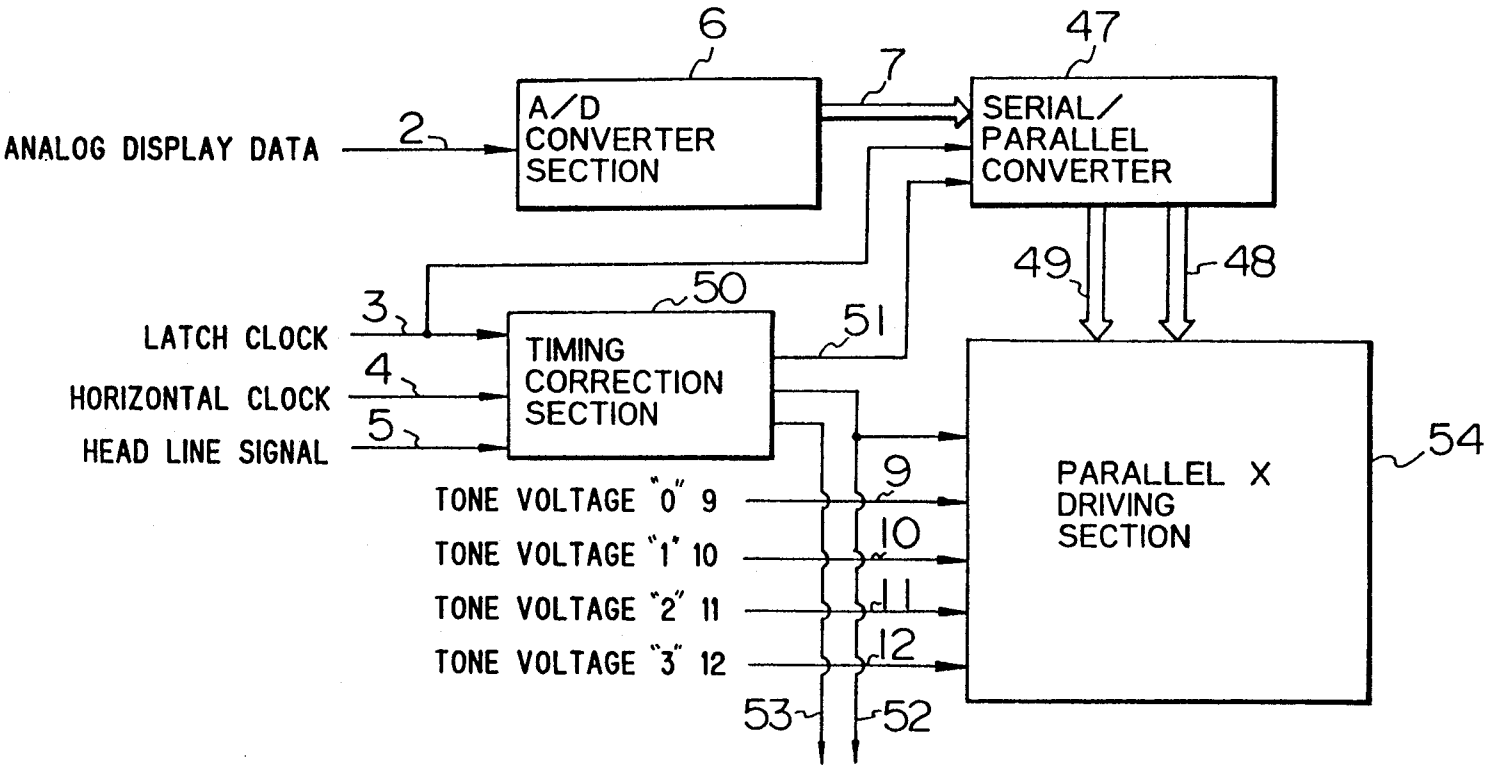
FIG. 6 is a block diagram of the main part of LCM according to the second embodiment of the present invention.
Figure 7:
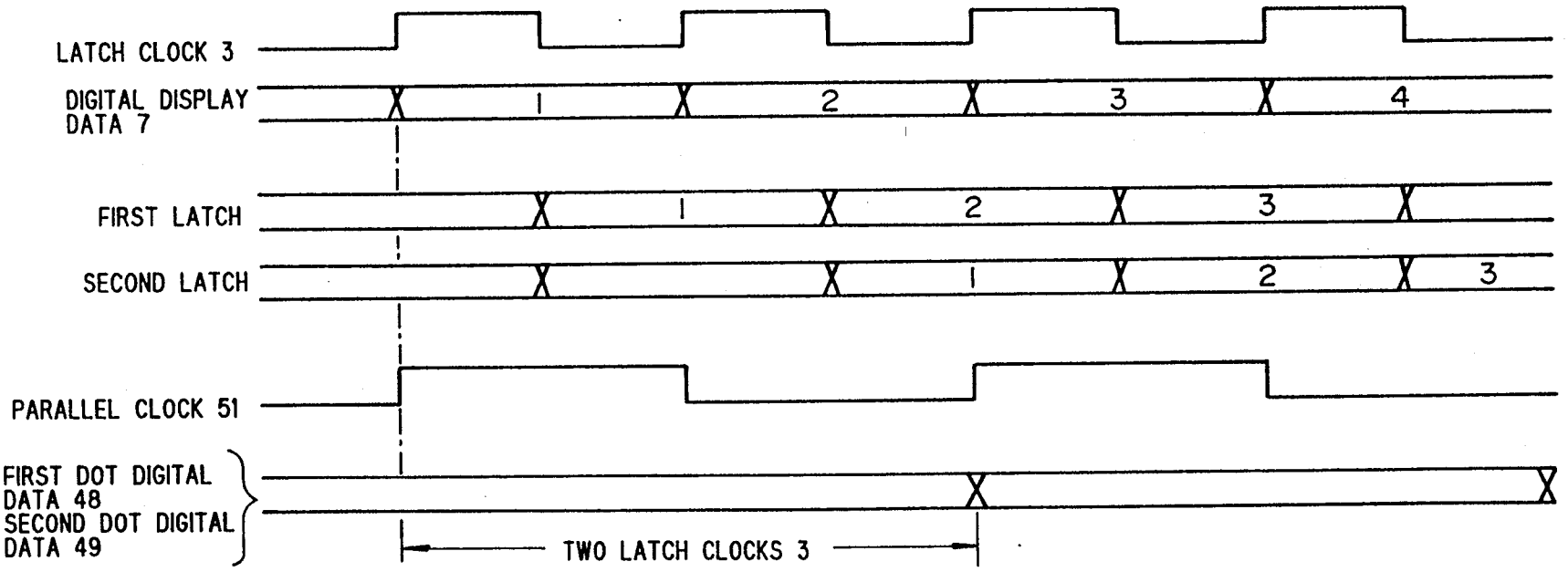
FIG. 7 is a timing chart for explaining the operation of the serial-parallel converter means of FIG. 6.
Figure 8:
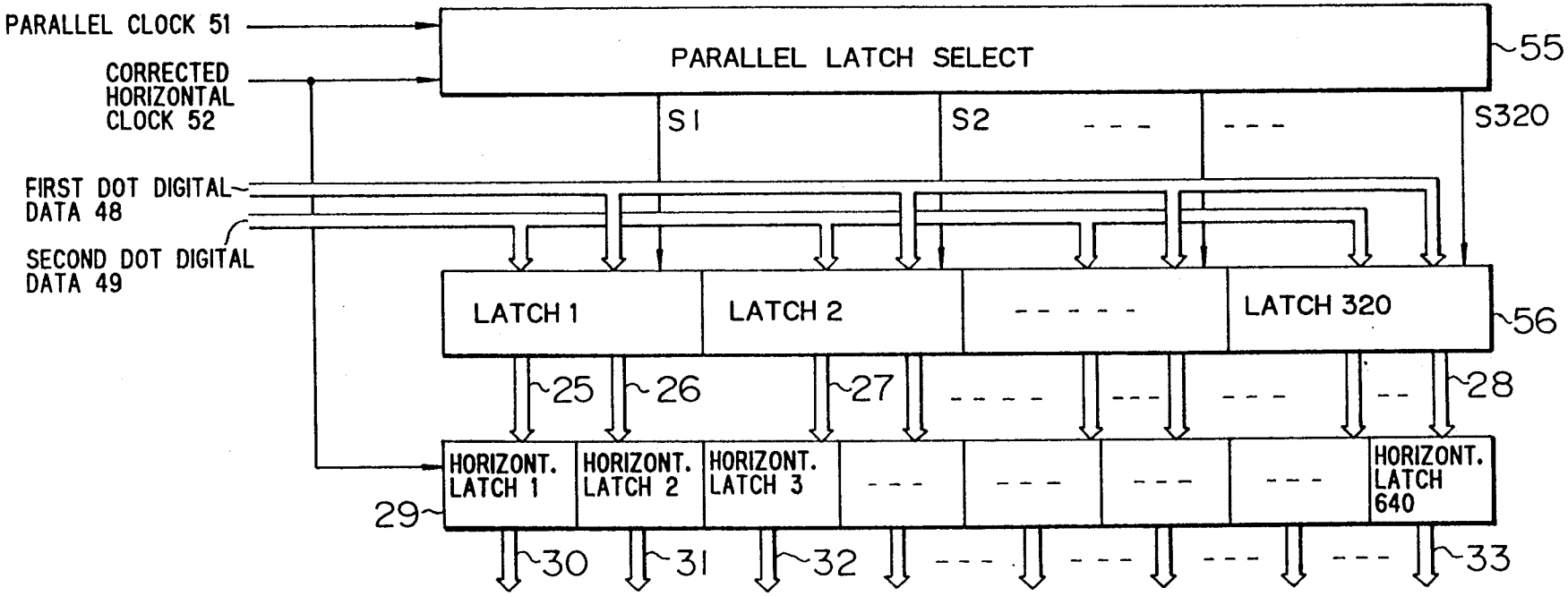
FIG. 8 is a block diagram of an input part of the parallel X driving section of FIG. 6.

With reference to FIGS. 6 to 8, another embodiment of the multi-tone LCM will be explained. In this embodiment, it should be noted that a parallel input of M (M is a positive integer) dots are applied to the X driving section and it is assumed that M=2.

In FIG. 6, like reference numerals denote like elements in FIG. 3. 47 is a serial-parallel converter section. 48 is a first dot digital data and 49 is a second dot digital data. The serial-parallel converter section 47 converts 2 bit serial digital data 7 from the A-D converter section 6 into a parallel data consisting of the first dot digital data 48 and the second dot digital data 49, each data consisting of 2 bits. 50 is a timing correction section. 51 is a parallel clock. 52 is a correction horizontal clock. 53 is a correction head line signal. In response to the latch clock 3, the timing correction section 50 generates a parallel clock 51 in synchronism with the parallel data consisting of the first dot digital data 48 and the second dot digital data 49. Further, in order to correct the phase deviation of data due to the serial-parallel conversion of the display data, the timing correction section 50 corrects the horizontal clock 4 and the head line signal 5 using the latch clock 3 to provide a corrected horizontal clock 52 and a corrected head line signal 53. 54 is a parallel X driving section which serves to sequentially take in the 2 bit parallel display data in synchronism with the parallel clock 51.

FIG. 7 is a timing chart showing the operation of the serial-parallel conversion section 47. FIG. 8 is a block diagram of the input port of the parallel X driving section 54. In FIG. 8, 55 is parallel latch select which is cleared by the corrected horizontal clock 52 and thereafter sequentially boosts select signals S1, S2, . . . S320 to "high". 56 is a parallel latch circuit; the latch block thereof for which the select signal is "high" latches simultaneously the first dot digital data 48 and second dot digital data 49 at the timing of the parallel clock 51. The other reference numerals in FIG. 8 denote like elements in FIG. 4.

The operation of the multi-tone LCM shown in FIG. 6 will be explained. The analog display data 2 having four value voltage levels is the 2 bit digital display data 7 by the analog-digital converter section 6. This digital display data 7 is converted into 2 bit parallel data, as shown in FIG. 7, to provide the first dot digital data 48 and second dot digital data 49 which are in synchronism with the parallel clock 51. Then, as shown in FIG. 7, owing to the serial-parallel conversion, the phase of the output data lags the input data by 2 (two) latch clocks 3. In order to correct this lag, the timing correction section 50 also causes the horizontal clock 4 and the head line signal 5 to lag by 2 latch clocks 3. The resulting corrected horizontal clock 52 and corrected head timing signal 53 are applied to the X driving section 54 and the Y driving section 16. As seen from FIG. 8, the X driving section 54 takes the first dot digital data 48 and the second dot digital data 49, in synchronism with the parallel clock 51, into its one block to which the "high" select signal is applied from the parallel latch select 55. The parallel latch select 55 is cleared by the corrected horizontal clock 52 and thereafter sequentially boosts the select signals S1 to S320 to "high". Thus, the parallel latch circuit 52 also latches the data in the order of latch blocks 1, 2, . . . 320 to finally latch the data corresponding to one line. The outputs from the blocks of the parallel latch circuit 56 are latched in the horizontal latch circuit 52 at the timings of the corrected horizontal clock 52. The following operation is the same as that in FIG. 4. Thus, parallel data X1 to X640 are provided as panel data.

As understood from the above explanation, two dots can be used as an input to the X driving section 46 by providing the serial-parallel conversion section 47, causing the internal port of the X driving section 46 to simultaneously latch two dots and providing the timing correction section for correcting the phase lag due to the serial-parallel conversion. This can enhance the operation speed of the circuits successive to the A-D converter section 6. In another embodiment of the invention, the timing correction section 50 is not required when the input timing is determined in consideration of the phase delay in the serial-parallel conversion section 47 (two latch clocks 3) so that the horizontal clock 4 and the head line signal 5 can be directly used without correction. Incidentally, although in this embodiment, the input to the X driving was 2 bits for each of 2 dots, the input of N bit(s) (N is an integer of 1 or more) for each of M dots (M is an integer of 2 or more) can be realized in the same way.

Figure 9:
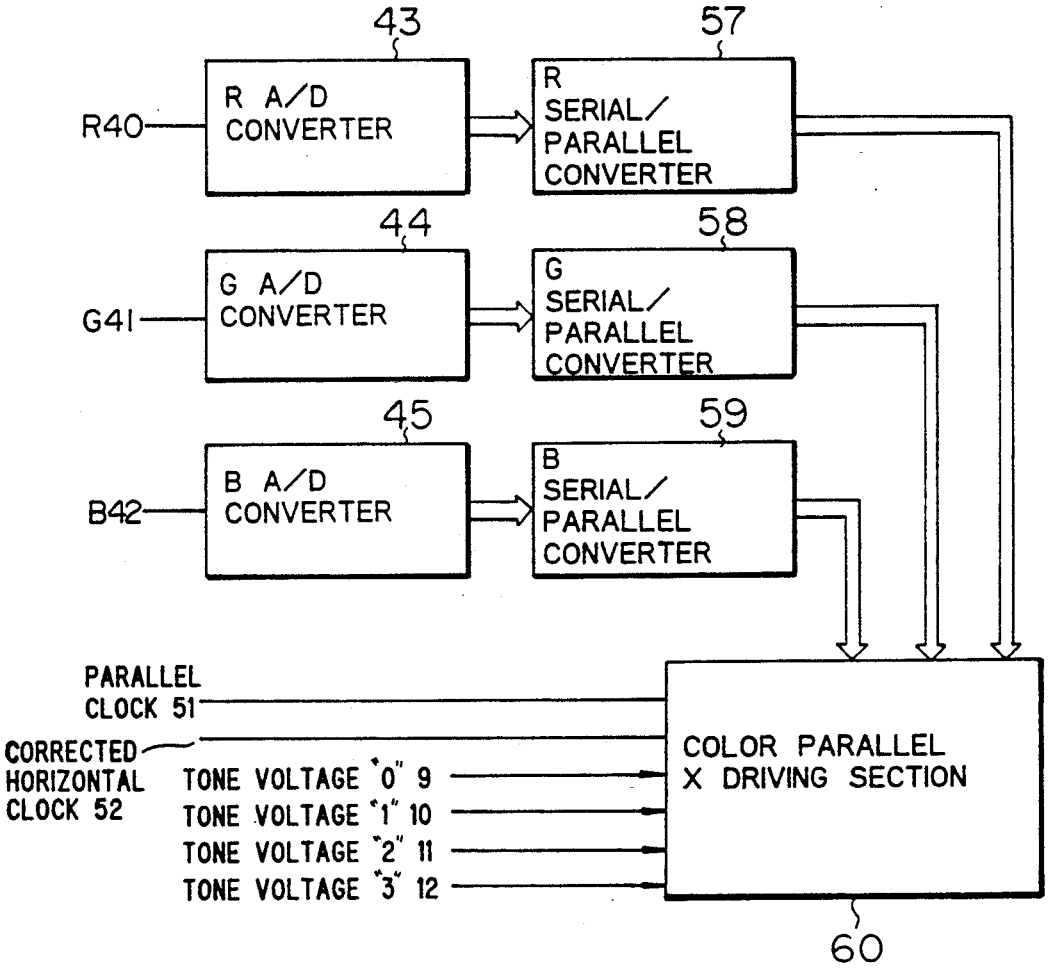
FIG. 9 is a block diagram of the main part of another embodiment of a liquid crystal matrix display device for color display according to the present invention.

A second embodiment of the LCM for color display as shown in FIG. 9 can be realized by providing R, G and B serial-parallel converter sections 57, 58 and 59, and providing a color parallel X driving section 60 with three columns of the arrangement of FIG. 8.

Further, although the explanation hitherto made was directed to a liquid crystal display device, the same idea can be also applied to the other display devices such as a plasma display, EL display, etc.

In accordance with the present invention, an LCM for multi-tone display or multi-color can be realized thereby to decrease the number of input lines to LCM. Moreover, by using an analog input to decrease the number of data bits, noise to be generated can be reduced. Further, by carrying the parallel operation of the X driving section, the operation speed can be enhanced. Furthermore, since the voltages in accordance with N bit decoded values can be selected as outputs from the X driving section, tone voltage with less fluctuation can be provided.

We claim:

1. An image display device comprising:

a matrix display panel having plural X direction signal lines and plural Y direction signal lines intersecting said plural X direction signal lines at intersecting points, the intersecting points of said matrix being pixels of a display image;

X direction driving means for receiving digital image data and for sequentially scanning said plural X direction signal lines to provide image signals;

Y direction driving means for driving said plural Y direction signal lines in synchronism with the scanning of said plural X direction signal lines to sequentially provide select signals to said plural Y direction signal lines;

A–D converter means for receiving an analog image signal and converting said analog image signal into a digital image signal;

voltage generating means for simultaneously generating a plurality of discrete output signals at respectively different voltage levels, each of said voltage levels being a constant level; and selector means for selecting one of said constant output signals from said voltage generating means in accordance with an output from said A–D converter means to provide said one of said output signals to said X direction driving means as said image signals.

2. An image display device according to claim 1, wherein said matrix display panel comprises a liquid crystal display panel.

3. An image display device according to claim 1, wherein said matrix display panel comprises a plasma display panel.

4. An image display device according to claim 2, wherein said liquid crystal display panel comprises liquid crystal cells capable of distinguishably displaying colors corresponding to N bits of information for one pixel, where N is a positive integer and said voltage generating means generates signals at different $2^N$ kinds of voltage levels.

5. An image display device according to claim 2, wherein said liquid crystal display panel comprises a plurality of display elements radiating different colors, a combination of three of said plurality of display elements, each of the combination having a different color, said combination forming one pixel radiating a blended color, said plural X direction signal lines comprises three signal lines corresponding to said three different colors, and said A–D converter means comprises means for receiving N kinds of different color image analog signals and converting them into N kinds of different color image digital signals.

6. An image display device according to claim 1, wherein said A–D converter means converts said analog input signal into a M bit parallel digital signal to be supplied to said selector means, M being a positive integer.

7. The image display device as in claim 1, wherein said X direction driving means further comprises a latch selector to shift the select signals in synchronism with a latch clock, said latch selector being periodically cleared by a horizontal clock signal.

8. The image display device as in claim 7, wherein said X direction driving means further comprises a latch circuit to receive said digital image signal which is sequentially generated by said A–D converter means.

9. The image display device according to claim 8, wherein said X direction driving means further comprises a horizontal latch circuit which latches the data from the latch circuit in synchronism with each horizonal clock signal to generate horizontal digital data.

10. The image display device according to claim 9, wherein said X direction driving means further comprises decoder means to decode the horizontal data to generate a decoder signal.

11. The image display device according to claim 10, wherein said selector means comprises voltage selector means to select an output signal in the form of a tone voltage from said voltage generating means, said tone voltage corresponding to said decoder signal.

12. The image display device according to claim 1, wherein said plural different voltage levels are $2^N$ voltage levels.

13. The image display device according to claim 1, wherein said plural different voltage levels are 4.

14. An image display device comprising:

a matrix display panel having plural X direction signal lines and plural Y direction signal lines intersecting said plural X direction signal lines at intersecting points, the intersecting points of said matrix being pixels of a display image;

parallel X direction driving means for receiving a first dot digital data and a second dot digital data and sequentially scanning said plural X direction signal lines to provide image signals;

Y direction driving means for driving said plural Y signal lines in synchronism with the scanning of said plural X direction signal lines to sequentially provide select signals to said plural Y direction signal lines;

A–D converter means for receiving an analog image signal, said analog image signal comprising first dot analog data and second dot analog data and converting said analog image signal into a serial digital image signal;

serial to parallel converter means to convert said serial digital image signal into parallel digital image data, said parallel digital image data comprising said first dot digital data and said second dot digital data;

voltage generating means for simultaneously generating a plurality of discrete output signals at respectively different voltage levels, each of said voltage levels being a constant level; and selector means for selecting one of said constant output signals from said voltage generating means in accordance with an output from said A–D converter means to provide said one of said output signals to said X direction driving means as said image signal.

15. The image display device according to claim 14, wherein said image display device further comprises timing correction means for correcting the phase deviation between the serial digital image data and the parallel digital image data.

16. The image display device according to claim 15, wherein said timing correction means comprises horizontal clock correction means to generate a corrected horizontal clock signal, said parallel X direction driving means receiving said corrected horizontal clock signal.

17. The image display device according to claim 15, wherein said timing correction means generates a parallel clock, said parallel clock corresponding to said parallel digital image data.

18. The image display device according to claim 15, wherein said timing correction means further comprises a corrected head line signal.

19. An image display device comprising:

a matrix display panel having plural X direction signal lines and plural Y direction signal lines intersecting at intersecting points, wherein said intersecting points comprise pixels of a display image;

voltage generating means for simultaneously generating a plurality of discrete output signals, at respectively different and constant voltage levels, according to tones to be displayed at said display image pixels;

A-D converter means for receiving an analog image signal and converting said analog image signal into a digital image signal;

X direction driving means for receiving digital image data from said A-D converter means and for sequentially scanning said plural X direction signal lines to provide image signals;

Y direction driving means for driving said plural Y direction signal lines in synchronism with said sequential scanning of said plural X direction signal lines to sequentially provide signals to said plural Y direction signal lines; and selector means for selecting one of said output signals from said voltage generating means in accordance with an output from said A-D converter means to provide said output signal to said matrix display panel as said image signal.

20. An image display device comprising:

a matrix display panel having plural X direction signal lines and plural Y direction signal lines intersection at intersecting points, said intersecting points being pixels of a display image;

voltage generating means for simultaneously generating a plurality of discrete output signals at respectively different constant voltage levels;

A-D converter means for receiving an analog image signal, said analog image signal comprising first dot analog data and second dot analog data, and for converting said analog image signal into serial digital image signals;

serial to parallel converter means for converting said serial digital image signals into parallel digital image data, said parallel digital comprising said first dot digital data and said second dot digital data;

X direction driving means for receiving a first dot digital data and a second dot digital data and for sequentially scanning said plural X direction signal lines to provide image signals thereto;

Y direction driving means for driving said plural Y signal lines in synchronism with scanning of said plural X direction signal lines to sequentially provide select signals to said plural Y direction signals lines; and selector means for selecting one of said output signals from said voltage generating means in accordance with an output from said A-D converter means to provide said one of said output signals to said matrix display panel as said image signals.

* * * * *